United States Patent [19]

Downing et al.

[11] 4,361,230

[45] Nov. 30, 1982

[54] ASSEMBLY OF TUBULAR SLEEVE MARKERS

[75] Inventors: Gerald T. Downing, Port Washington; Eugene R. Stepanski, Brown Deer; Gary J. Wirth, Milwaukee, all of Wis.

[73] Assignee: W. H. Brady Co., Milwaukee, Wis.

[21] Appl. No.: 306,044

[22] Filed: Sep. 28, 1981

[51] Int. Cl.[3] ..... B65D 85/20; B65D 63/00

[52] U.S. Cl. ..... 206/345; 206/390; 206/820

[58] Field of Search ..... 206/345, 390, 820, 343; 229/62, 69; 24/17 B, 17 AP

[56] References Cited

U.S. PATENT DOCUMENTS

| | | | |
|---|---|---|---|
| 2,832,712 | 4/1958 | Deinlein et al. | 206/820 |
| 3,221,871 | 12/1965 | Hidding | 206/306 |
| 3,229,875 | 1/1966 | Stoller | 206/390 |
| 3,894,731 | 7/1975 | Muller | 269/47 |
| 3,896,524 | 7/1975 | Parker | 206/390 |
| 4,032,010 | 6/1977 | Evans | 206/345 |

FOREIGN PATENT DOCUMENTS

| | | | |
|---|---|---|---|
| 513038 | 8/1952 | Belgium | 206/820 |

OTHER PUBLICATIONS

"Raychem TMS", Product Bulletin of Raychem Corporation apparently dated Sep., 1978.

"Brady Vinyl Sheet Sleeves", Form No. MS-284, product sheet of W. H. Brady Co., dated 1972.

"CP Wire Marking Sheets", product bulletin of Cox Plastics Corporation apparently dated May, 1970.

*Primary Examiner*—William T. Dixson, Jr.

*Assistant Examiner*—Brenda J. Ehrhardt

*Attorney, Agent, or Firm*—Quarles & Brady

[57] ABSTRACT

An assembly of tubular sleeve markers formed by one or more top webs joined to a base web along transverse seams. The top webs are narrower in width than the base web. The base web has opposed marginal edge portions that extend beyond the top webs. Separable line means are formed in the base web in the marginal edge portions. The sleeve markers are individually detachable from the assembly.

12 Claims, 14 Drawing Figures

FIG. 1
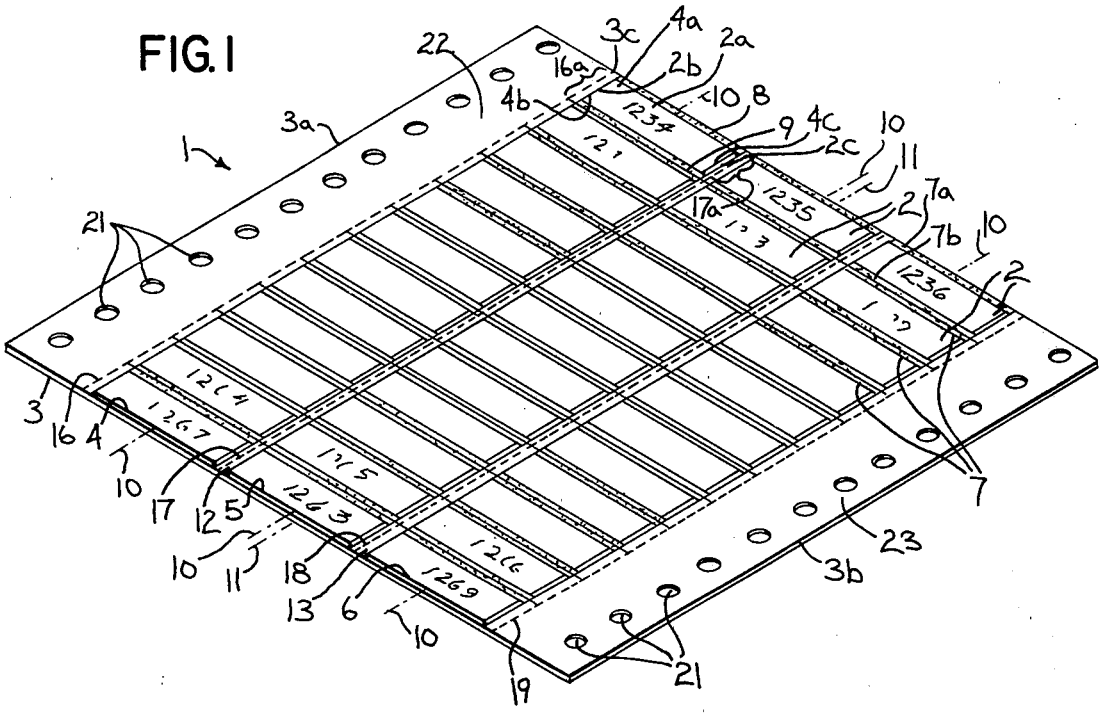
FIG. 5
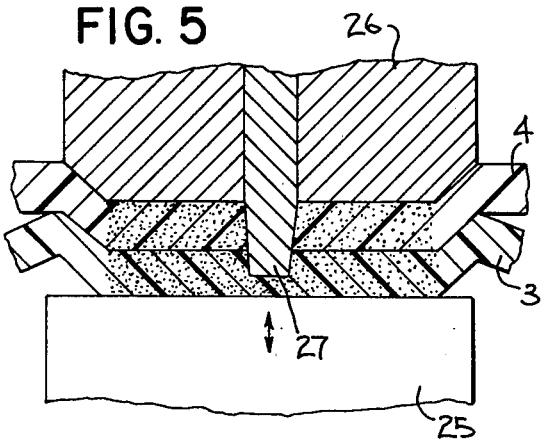
FIG. 6
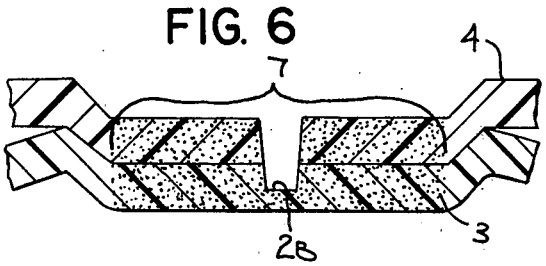
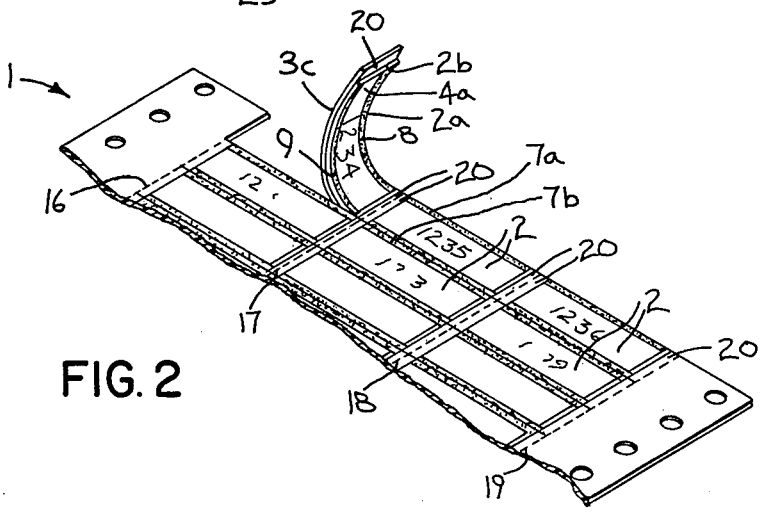
FIG. 2

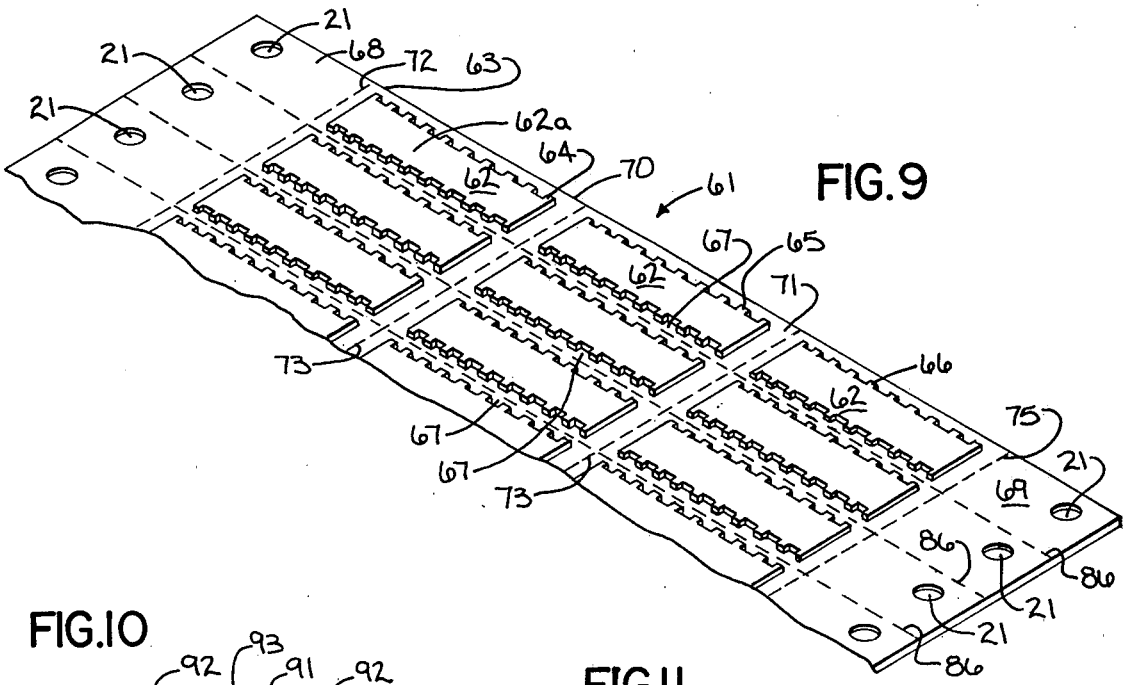
FIG.9
FIG.10
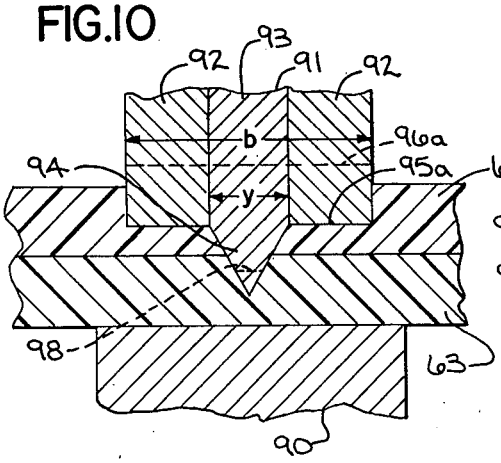
FIG.11
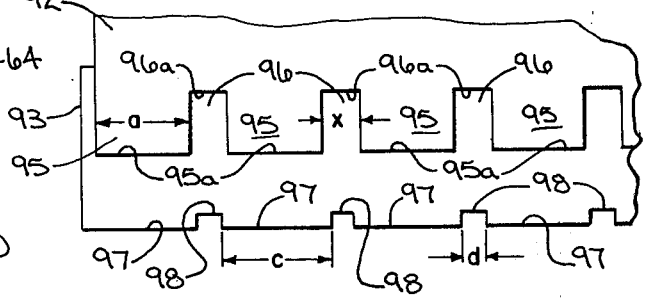
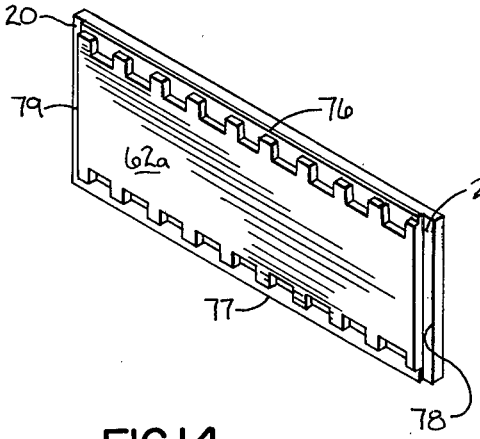
FIG.14
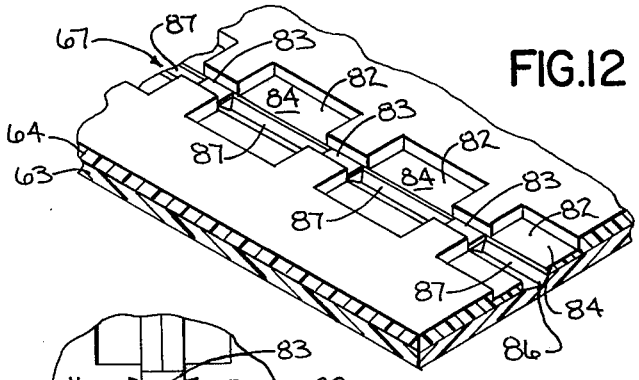
FIG.12
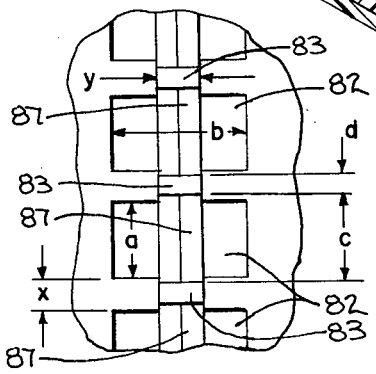
FIG.13

ASSEMBLY OF TUBULAR SLEEVE MARKERS

TECHNICAL FIELD

This invention is concerned with sleeve markers of tubular structure useful for identifying various types of objects, such as electrical wires, for example.

BACKGROUND ART

Tubular sleeve markers are slipped over an object for use as an identification device, and the markers may be color-coded or carry alpha-numeric information in order to provide the required identification information. A typical use of sleeve markers is to provide individual identification of each electrical wire in a group of wires arranged together in a harness or bundle.

One form of prior art tubular sleeve marker is made from plastic tubing cut into sleeves of the desired length. The tubing may be made of heatshrinkable or non-heatshrinkable material, depending upon the intended end use. Sleeve markers of this type usually are supplied to the customer as a package of individual sleeves, but this has a disadvantage in that a user cannot apply specific identification information to the sleeves at the time they are to be applied to an object. One solution to this problem is that described in U.S. Pat. No. 3,894,731. Flattened sleeves are carried on tines extending from a supporting spine. This construction, however, requires modified or special printing equipment to enable a user to apply alpha-numeric information to the sleeves and also is a relatively high cost sleeve marking system. Another prior art sleeve marker was sold in the form of a large assembly (11"×14") consisting of two sheets of vinyl films of equal width sealed together with spaced horizontal seals to form a three-dimensional structure of long sleeves that a user was to cut into sleeves of the desired length; the product met with limited acceptance as it was cumbersome and inconvenient for a customer to use.

DISCLOSURE OF THE INVENTION

Our present invention comprises an assembly of tubular sleeve markers made of flat flexible sheet material and including a base web and one or more top webs joined together along spaced parallel transverse seams. Tubular sleeve markers are defined between each adjacent pair of transverse seams.

When the assembly is made with a single top web, the top web is narrower in width than the base web, and marginal edge portions of the base web extend beyond each of the opposed edges of the top web. Separable line means are defined in the two marginal edge portions of the base web, either underlying an edge of the top web or slightly spaced therefrom. Individual sleeve markers are detachable from the assembly along the transverse seams and the separable line means.

When the assembly is made with a plurality of top webs joined to a base web along transverse seams, the top webs are each narrower in width than the base web and they are separated from one another by longitudinal spaces. Two opposed marginal edge portions of the base web extend beyond the top webs, and separable line means are formed in the edge portions. Additional separable line means are defined in the base web in each space between the top webs. An individual sleeve marker is detachable from the assembly along the separable line means and the transverse seams.

A row of spaced apertures may be formed in each of the opposed marginal edge portions of the base web so that the assembly can be fed through printing equipment incorporating a sprocket drive to thereby facilitate the printing of serial or customized identification information on each sleeve marker.

The above assemblies are in flat condition when supplied to a user so that they can be conveniently fed through various types of printing equipment. Each sleeve marker in an assembly is printed with the selected information, after which an individual sleeve marker can be detached from the assembly for application to an object while the remaining sleeve markers are retained as part of the assembly and available for later use.

BRIEF DESCRIPTION OF THE DRAWINGS

FIG. 1 is a perspective view of an assembly of tubular sleeve markers made in accordance with the present invention;

FIG. 2 is a perspective view of a portion of the assembly of FIG. 1 illustrating one of the sleeve markers partially detached from the assembly;

FIG. 5 is a partial sectional view illustrating apparatus for the formation of the transverse seams of the assembly of FIG. 1;

FIG. 6 is a sectional view of a transverse seam formed with the apparatus of FIG. 5;

FIG. 9 is a perspective view of a portion of a third assembly of tubular sleeve markers made in accordance with the present invention illustrating structural details not found in the previously described assemblies;

FIG. 10 is a partial sectional view illustrating apparatus for the formation of the transverse seams of the assembly of FIG. 9;

FIG. 11 is a side view of the anvil of the apparatus illustrated in FIG. 10;

FIG. 12 is an enlarged perspective view, with portions broken away, of a part of the assembly of FIG. 9;

FIG. 13 is a plan view of a portion of a transverse seam as shown in FIGS. 9–12; and FIG. 14 is a perspective view of an individual sleeve marker fully detached from the assembly of FIG. 9.

BEST MODES FOR CARRYING OUT THE INVENTION

I. Embodiment of FIGS. 1–7

(a) Structural Description

Figure 7:
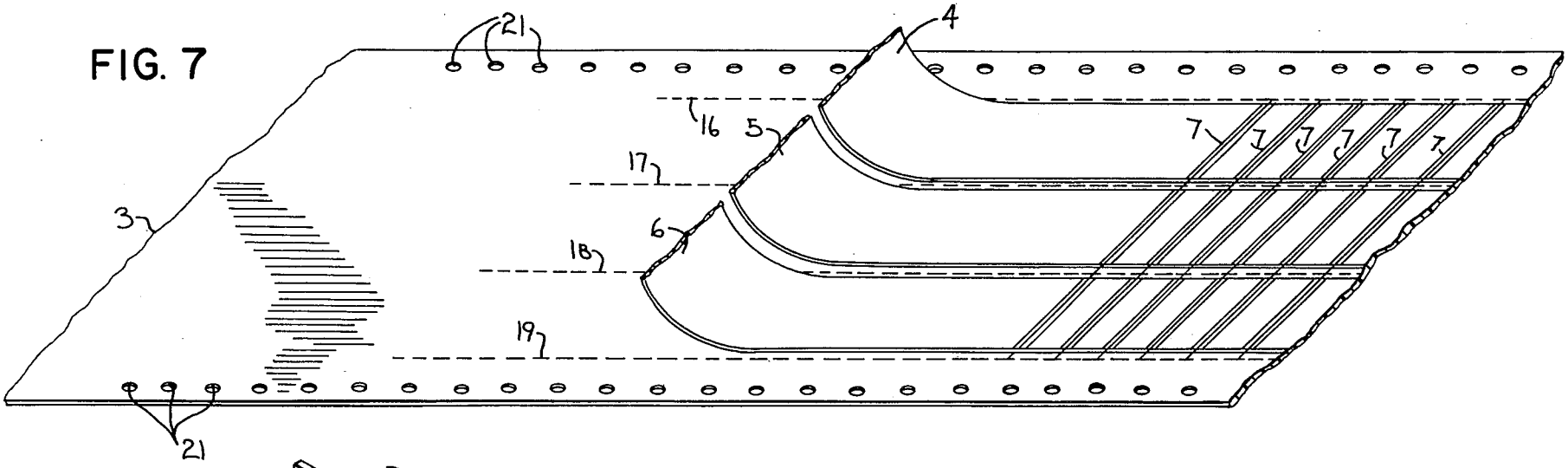
FIG. 7 is a schematic view depicting steps in a process for the manufacture of the tubular sleeve assembly illustrated in FIG. 1.

FIG. 1 illustrates an assembly 1 of individual tubular sleeve markers 2 detachably joined together. As discussed in greater detail below, each tubular sleeve marker is to be separately detached from the assembly when it is to be applied to an object while the non-detached sleeve markers remain as part of the assembly. The assembly 1 is illustrated in sheet-form, but it may also be made in roll-form or as a fan-folded group of flat sheets joined together at their ends.

The assembly 1 of sleeve markers is made with a base web 3 and three top webs 4, 5 and 6 that are joined together along a plurality of transverse seams or sealed zones 7. The base and top webs are joined together only along the transverse seams. Each sleeve marker 2 has opposed closed edge portions 8 and 9 (see sleeve marker 2*a* in FIGS. 1 and 2) that are defined by an adjacent pair 7*a* and 7*b* of transverse seams. The transverse seams are spaced apart from one another at selected intervals or distances as required to define individual sleeve markers of the desired circumferential size. For example, most computer printers operate either at 6 lines per inch or 8 lines per inch, and the spacing between the transverse seams can be selected to provide sleeve markers in widths appropriate for either system if they are to have data applied by a computer printer. One-half of a sleeve marker is made from a portion of the base web between adjacent spaced transverse seams and the other half is made from a superposed portion of one of the top webs between the same pair of spaced transverse seams.

As depicted in FIG. 1, the three top webs 4, 5 and 6 are arranged in face-to-face relationship with the base web 3 with the longitudinal axis 10 of each top web positioned parallel to the longitudinal axis 11 of the base web. The transverse seams 7 extend at right angles to the longitudinal axes of the base web and top webs. Each top web is narrower in width than the base web, and the width of a top web is selected to establish the desired length of the sleeve markers. There is a space 12 between the top webs 4 and 5 and a similar space 13 between the top webs 6 and 7.

A plurality of longitudinally extending separable line means 16, 17, 18 and 19 are formed in the base web 3. The separable line means 16–19 are parallel to one another and parallel to the longitudinal axes 10 and 11 of the top and bottom webs. The separable line means 16 is spaced inwardly of the longitudinal edge 3*a* of the base web 3, and separable line means 19 is spaced inwardly of the longitudinal edge 3*b* of the base web. The separable line means 17 is defined in the exposed section of the base web in the space 12 between the top webs 4 and 5, and separable line means 18 is formed in the exposed section of the base web in the space 13 between the top webs 5 and 6. The base web is to be manually separable along the separable line means 16–19. For this purpose, the separable line means may be defined by continuous score lines partially penetrating the base web, a row of perforations, a series of separated slits or score lines, or other suitable constructions that will permit separation by hand. The separable line means 16–19 are illustrated in FIG. 1 as comprising rows of short spaced rectilinear slits in which each slit extends through the thickness of the base web.

Each individual sleeve marker 2 as described above is formed from two portions joined together along their edges one of which comprises a portion of a top web 4–6 and the other a portion of the base web between a spaced pair of separable line means. For example, one-half of sleeve marker 2*a* consists of a portion 4*a* of the top web 4 and the other half consists of portion 3*c* of the base web 3 extending between the separable line means 16 and 17. The closed edges of marker 2*a* are formed by portions of the transverse seams 7*a* and 7*b*. The separable line means 16–19 each define one-half of the opposed open ends of the tubular sleeve markers 2. Thus, with reference again to the sleeve marker 2*a*, portion 16*a* of the separable line means 16 forms one-half of the open end 2*b* of the sleeve and portion 17*a* of the separable line means 17 forms one-half of the opposite open end 2*c* of the sleeve. The other half of each open end of the sleeves is formed by an edge of a top web 4–6. With respect to sleeve marker 2*a*, an edge portion 4*b* of the top web 4 forms one-half of the open end 2*b* and an opposite edge portion 4*c* of top web 4 forms one-half of its opposite open end 2*c*.

As best visible in FIG. 2, but also shown in FIG. 1, each of the separable line means 16–19 is slightly spaced from the free edge of its adjacent top web or webs. Thus, as to each tubular sleeve marker 2, the half thereof formed from a portion of the bottom web is slightly longer than the half formed by a portion of a top web. A short tab 20 is thereby defined at each end of a tubular sleeve marker which comprises the end portions of the bottom web that extend beyond each end of the portion of the top web forming part of a sleeve marker.

Figure 3:
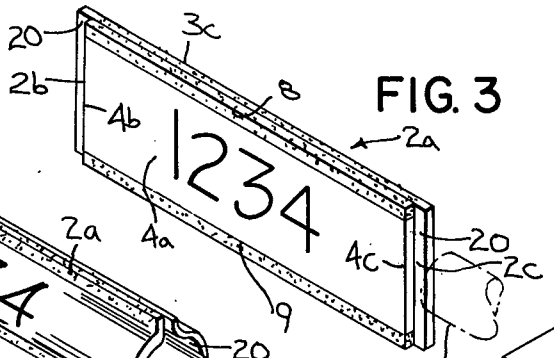
FIG. 3 is a perspective view of an individual sleeve marker fully detached from the assembly of FIG. 1.

FIG. 3 is a perspective view of sleeve marker 2*a* with its various parts identified in accordance with the foregoing description, in which the stippled portions depict its closed edge portions 8 and 9.

A row of evenly spaced apertures 21 is formed within the marginal edge portion 22 of the base web 3 between its edge 3*a* and separable line means 16. A similar row of apertures 21 is formed along the opposite marginal edge portion 23 of the base web between its edge 3*b* and separable line means 19. When utilized in the assembly 1, the apertures 21 are intended for engagement with a web sprocket drive such as associated with line printers used with word processing equipment and computers. This enables automatic equipment to be employed to print suitable alpha-numeric indicia on the individual tubular sleeve markers 2. Users of sleeve markers often have a need to custom print a large number of sleeves with sequential or coded identification numbers, and the assembly 1 is suitable for such purposes.

Each of the sleeve markers 2 can carry an appropriate alpha-numeric identification legend on one or both of its surfaces, such as the sequential numeric legends illustrated on the top webs of the markers in FIGS. 1–4. The legends can be applied by the user of the assemblies 1 by the use of suitable equipment such as described above, or pre-printed by the manufacturer. The legends or other identification indicia can be applied by printing, hot stamping, embossment, typing, writing, or other suitable techniques. Also, the markers can be supplied in various solid colors or stripes, with or without indicia, when appropriate for a particular identification use.

(b) Operation

Figure 4:
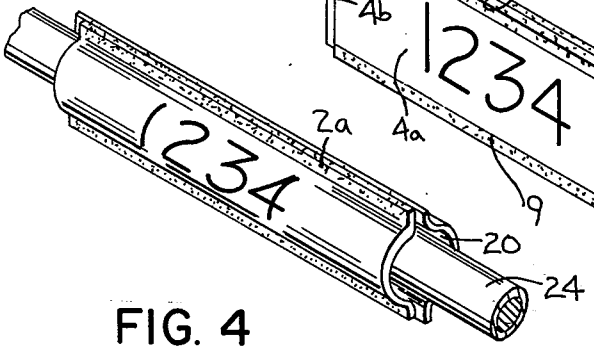
FIG. 4 is a perspective view of the sleeve marker of FIG. 3 inserted on a wire for identification purposes.

FIG. 2 illustrates an individual tubular sleeve marker in the process of being separated from the assembly 1. Each sleeve marker is detachable from the assembly along the transverse seams 7 and separable line means 16–19. Sleeve marker 2*a* is shown in a partially detached condition in which one of its ends has been separated from the assembly along the separable line means 16, and one of its closed edges has been separated along a transverse seam 7. After being detached along separable line means 17, the sleeve marker 2*a* is ready to be inserted along a wire or other object to be identified as illustrated in FIG. 3. The portion 3*c* of the sleeve marker from part of the base web 3 includes tabs 20 that extend beyond each end of the portion 4*a* of the marker formed from the top web 4*a*. The sleeve marker is in a flattened condition at the time it is detached from the assembly, and the tabs 20 are employed to facilitate opening it into a tubular condition. A wire 24 to be marked with the sleeve is illustrated in phantom line in FIG. 3, and an end of the wire can be brought alongside a tab 20 at open end 2*c* and slightly pushed against the tab so as to open up the marker. If desired, an appropriately shaped tool can be used for the same purpose. The marker is then moved along the wire 24 to its desired final position as illustrated in FIG. 4.

(c) Transverse Seam Formation

FIG. 5 illustrates a particularly useful apparatus and method for making the transverse seams 7, and FIG. 6 illustrates a seal formed thereby. Referring first to FIG. 5, the base web 3 and top web 4 are positioned between the horn 25 and anvil 26 of a suitable ultrasonic welding or sealing machine. The anvil 26 has a narrow bar or knife edge 27 projecting from its frontal face which contacts the top web 4. The ultrasonic welding machine may be selected from a wide variety of commercially-available ultrasonic welding machines, e.g. machines sold by Branson Sonic Power Company of Danbury, CT. The seam formed with the ultrasonic sealing means of FIG. 5 is shown in FIG. 6. A transverse seam 7 joins the top web 4 to the base web 3. A weakened zone 28 is formed centrally of the transverse seam 7 simultaneously with the formation of the seam due to the action of the bar 27. The zone 28, which is a necked-downed or thinned-out portion of the top and base webs, forms a weakened area or separation means along which a transverse seam can be separated manually so that an individual sleeve marker is detachable from the assembly. Ultrasonic sealing is particularly effective for making the transverse seams in the assembly 1 because a narrow seam of high strength can be made, such as on the order of 0.010" to 0.030" wide. However, other means to form the transverse seams for joining the top and bottom webs together can be employed, such as heat sealing, dielectric sealing, mechanical seaming, etc.

(d) Materials

The base web 3 and top webs 4–6 are to be made of flexible sheet materials. Useful materials include flexible thermoplastic films such as polyester films, acrylate films, vinyl films, nylon films and polyolefin films such as polyethylene and polypropylene. One or both of the webs may also be made of paper, particularly paper having a polyethylene coating so as to be ultrasonically or heat sealable. The base web and top webs may be made of the same materials, or dissimilar materials if more suitable for a particular end use. The specific flexible sheet material for making an assembly 1 should be selected to provide the properties considered necessary for a particular end-use, such as temperature resistance, flame retardancy, solvent resistance, etc. Either the base or top webs, or both, can be made of heat-shrinkable materials as well as non-heatshrinkable sheet materials. Many of these film materials are inherently sealable ultrasonically or by heat sealing or dielectric means but, if not, suitable sealable coatings can be applied to the facing surfaces of the top and bottom webs that will be joined together to form the transverse seams 7. The printability of the sheet materials for the webs should also be considered; if a user is to apply identifying alphanumeric information to individual sleeve markers such as with a line printer or typewriter, the materials for the top webs should either be inherently printable or coated with a printable coating in order to provide the desired printability functionality.

II. Embodiment of FIG. 8

The assembly 1 is illustrated in FIG. 1 as combining three top webs with a single base web and similarly illustrated in FIG. 7. However, the assembly may also be constructed with only one top web joined to a base web, two top webs joined to a base web or more than three top webs joined to a base web if so desired.

Figure 8:
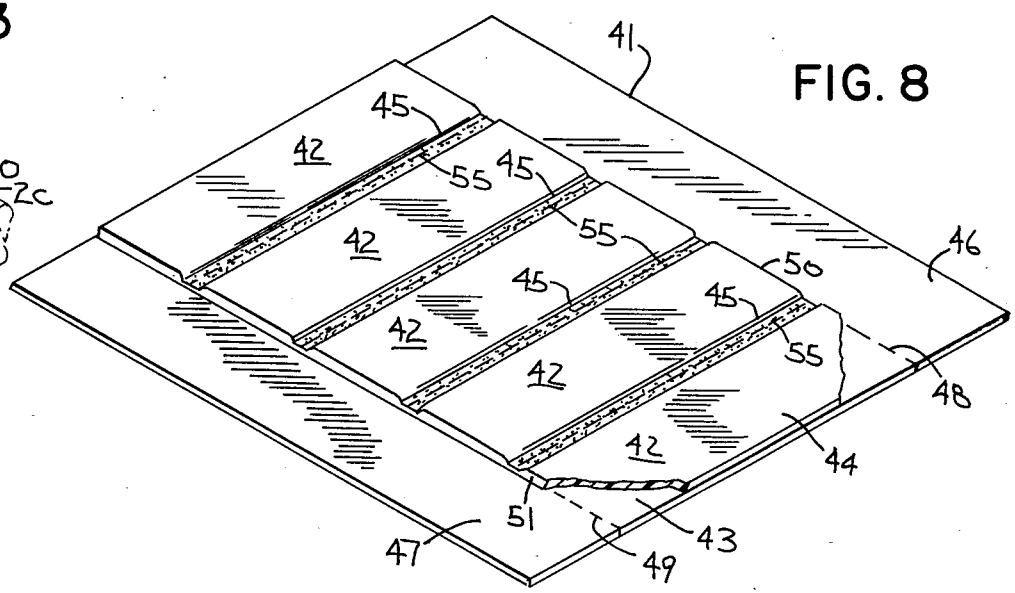
FIG. 8 is a perspective view with portions broken away of a second embodiment of an assembly of tubular sleeve markers according to the present invention.

Turning to FIG. 8, an assembly 41 of tubular sleeve markers 42 is made from a base web 43 to which a single top web 44 is joined along spaced parallel transverse seams 45 arranged perpendicular to the longitudinal axes of the base web and top web. Only one top web is used in the assembly 41, so that a single row of sleeve markers is contained in the assembly. The top web is narrower in width than the base web, and marginal edge portions 46 and 47 of the base web extend beyond the opposed edges of the top web. Separable line means 48 is defined in the marginal edge portion 46 of the base web, and separable line means 49 is defined in the marginal edge portion 47. However, the separable line means 48 and 49 are positioned in the base web immediately under the overlying edges 50 and 51, respectively, of the top web; thus, the sleeve markers 42 of the assembly 41 do not include the tab 20 of the sleeve markers 2 in the embodiment of FIGS. 1–7. This construction can be utilized when the tabs are considered unnecessary or undesirable for a particular application.

It will also be noted that the assembly 41 does not include the rows of apertures 21 in the marginal edge portions 46 and 47 of the base web. Thus, the assembly would be employed in those situations in which the user did not require on-site printing capabilities; the sleeve markers can be supplied to such a user with preprinted alpha-numeric information or color coding to provide the requisite identification information. However, the apertures 21 can be incorporated in the marginal edge portions 46 and 47 of the assembly 41 if so desired.

A transverse line of weakness 55 is formed along each transverse seam 45, preferably in the middle of the seam. The line of weakness 55 is employed as an alternate to the depressed weakened zone 28 of the prior embodiment as a means to facilitate manual separation of an individual sleeve marker from the assembly. The line of weakness 55 is illustrated as a row of short spaced slits, although it may also comprise a row of perforations, a long slit extending entirely across a transverse seam 45, or any other physical configuration or slitting arrangement that will enable manual separation of a sleeve marker.

In other respects, the sleeve markers 42 are the same as the sleeve markers 2 and are utilized in the same manner. The assembly 41 can be manufactured with a method similar to that illustrated in FIG. 7 but with the elimination of the edge hole punching and the addition of suitable die cutting equipment to form the lines of weakness 55.

III. Embodiment of FIGS. 9–14

FIG. 9 illustrates a presently-preferred embodiment of the sleeve marker assemblies of the present invention, which includes structural features that may also be incorporated in the previous embodiments.

As illustrated in FIG. 9, an assembly 61 of tubular sleeve markers 62 comprises a base web 63 to which three top webs 64, 65, and 66 are joined along spaced parallel transverse seams 67 extending perpendicular to the longitudinal axes (which are arranged parallel to one another) of the base and top webs. The base web is wider than the total width of the three top webs, and includes a first marginal edge portion 68 extending beyond the top web 64 adjacent thereto and a second marginal portion 69 extending beyond the top web 66 adjacent thereto. Apertures 21 may be formed in the marginal edge portions 68 and 69 for the purpose described previously in connection with the embodiment of FIGS. 1–7, although the apertures can be eliminated if so desired. The top webs are spaced from one another so that there is a space 70 between the top webs 64 and 65 and a space 71 between the top webs 65 and 66, the spaces 70 and 71 comprising exposed sections of the base web 63.

Longitudinally extending separable line means 72 is formed in the marginal edge portion 68 of the base web 63 and spaced slightly from the adjacent edge of the top web 64. Longitudinally extending separable line means 73 is formed in the space 70 between the top webs 64 and 65 and spaced slightly from the edges of the top webs; separable line means 73 is similarly formed in the space 71 between the top webs 65 and 66. Longitudinally extending separable line means 75 is formed in the marginal edge portion 69 of the base web and slightly spaced from the adjacent edge of top web 66.

An individual sleeve marker 62*a* is illustrated in FIG. 14 and is similar in construction to the sleeve marker 2*a* depicted in FIG. 3. The sleeve marker 62*a* has closed edge portions 76 and 77 which are formed as portions of transverse seams 67 and open ends 78 and 79 of which one-half is defined by portions of separable line means 72 and 73 and the other half is defined by opposed edges of a top web, top web 64 in the case of sleeve marker 62*a*. A short tab 20 is formed along each end of the tubular sleeve marker 62*a* which comprises end portions of the bottom web 63 between separable line means 72 and 73 and the respective adjacent edges of the top web 64. Sleeve marker 62*a* is used in the same manner as the prior embodiments.

The transverse seams 67 of the assembly 61 are constructed to provide a seam having a combination of high strength and easy separability. Referring first to the enlarged views of FIGS. 12 and 13, each seam 67 comprises an array of spaced seamed areas 82 separated by lands 83. The seamed areas 82 are larger in size than the lands 83, as indicated in the drawings. The exemplary embodiment has seamed areas 82 having dimensions "a" and "b" and lands 83 having dimensions "x" and "y". Each seamed area 82 has a central depressed area 84. Positioned medially of each transverse seam 67, there is formed a line of weakness 86 comprised of a series of spaced V-shaped grooves 87. Each groove 87 extends across a seamed area 82 and has its ends terminating within a land 83.

Apparatus suitable for forming the transverse seams 67 is illustrated in FIGS. 10 and 11. The base web 63 and the top webs, e.g. web 64, are positioned between the horn 90 and anvil 91 of a suitable ultrasonic welding or sealing machine (not shown). The anvil carries a seaming die made with first and second outer sealing elements 92 between which is sandwiched a knife-sealing element 93 having a V-shaped lower edge 94. The dimension "b" of the seaming die is equal to the dimension "b" of the seamed areas 82 and the dimension "y" of the element 93 is equal to the dimension "y" of the lands 83. Referring now to the plan view of FIG. 11, each outer sealing element 92 has a series of spaced seaming teeth 95 separated from one another by notches 96, the notches having an upper surface 96*a* spaced above the lower surface 95*a* of each seaming tooth. The dimension "a" of each tooth 95 is equal to the dimension "a" of each seamed area 82, and the dimension "x" of each notch 96 is equal to dimension "x" of each land 83. The knife sealing element 93 has its lower edge serrated or notched as shown in FIG. 11 to have sealing teeth 97 separated by notches 98. The dimension "c" of each tooth 97 is equal to the length "c" of each V-shaped groove 87 and the dimension "d" of a notch 98 is equal to the length of a space between each groove 87, both dimensions being measured along the axis of a seam 67.

When base web 63 and top webs 64–66 are placed in an ultrasonic welding machine in the position shown in FIG. 10, either the horn 90 or anvil 91 is raised or lowered, or otherwise brought into position, to engage the webs between the two elements, generally using air pressure to hold the webs in the desired position. The ultrasonic power source of the apparatus is energized for a time sufficient to simultaneously form the seamed zones 82 connected by lands 83, and grooves 87 of a transverse seam 67. It is difficult to illustrate the finished seam in the drawings, but there is some plastic flow of the films between their adjoining faces and also some plastic flow within at least a portion of the lands 83. The seamed zones 82 are formed as a series of small depressed sealed areas extending across each transverse seam. It has been found that a transverse seam 67 of the illustrated construction has a higher strength than the transverse seam 7 such as illustrated in FIGS. 1–7. Specifically, with seams of equal width and using the same films, it was found that the transverse seam 67 as described in the following example had a pull strength of 5 kilograms/inch measured on an Instron apparatus as compared to a 2.5 to 3.0 kilogram/inch pull strength with a transverse seam 7. The material strength of the films used in this test was about 8 to 9 kilograms/inch of sample. Thus the strength of the transverse seam 67 closely approximated the film strength itself and was on the order of twice the strength of the transverse seam 7. This feature provides a sleeve marker which is capable of withstanding more rigorous applications than with the previous seam constructions. At the same time, it was noted that the transverse seam 67 was easy to separate manually so that an individual marker 62 can be removed from the assembly.

EXAMPLE

An assembly 61 as illustrated in FIG. 9 was constructed using a base web 5 inches wide and four top webs, each about 15/16 inch wide, joined to the base web along transverse seams 67. The marginal edge portions 68 and 69 of the base web were ½ inch wide each, and apertures 21 were formed therein consisting of holes 5/32 inches in diameter spaced ½ inch on center. The top webs were each spaced about 1/16 inch apart. Separable line means 72 and 75 were cut in each marginal edge portion of the base web, and separable line means 73 were cut in the space between each pair of top webs, all such separable line means being positioned about 0.030 inches from the adjacent edge of a top web. Transverse seams 67 were spaced apart from one another to form individual marker sleeves 62 that were nominally ¼ inch wide and 1 inch long. The base web and top webs were all made from 10 mil thick polyvinylchloride-polyvinyl acetate copolymer film plasticized so as to form flexible sheet material. The films were coated with a printable coating along their exterior surfaces. With respect to the transverse seam 67, the seamed areas 82 were made with a "a" dimension of about 0.050 inch and "b" dimension of about 0.090 inch and the lands 83 with an "x" dimension of about 0.020 inch and "y" dimension of about 0.030 inch.

The assembly was suitable for feeding through a computer printing apparatus for application of alphanumeric information to each sleeve marker. The individual sleeve markers 62 were readily detached manually from the assembly 61. The tubular markers were of excellent strength and could be inserted onto a wire to provide a neatly fitted identification device, thereby meeting the objectives of the present invention.

IV. Method

FIG. 7 diagrams a particularly useful method for manufacturing the assemblies 1, 41 and 61, the method being illustrated in connection with an assembly 1. A base web 3 is unwound from a supply roll and advanced in a longitudinal direction through suitable apparatus to form the holes 21 along its opposed marginal edge portions and to form the longitudinally extending spaced separable line means 16–19, either as simultaneous operations or sequential operations in any order. Next, top webs 4, 5 and 6 are fed into position and suitably registered between the separable line means 16–19, after which the spaced transverse seams 7 are formed across the superposed webs to join each top web to the base web. The completed article is then advanced for cutting into sheets, winding into a roll or converted to a fan-fold arrangement, whichever is selected.

Industrial Applicability

The assemblies of tubular sleeve markers described hereinabove can be used in any industrial situation in which a tubular sleeve marker is required. Typical uses for the sleeve markers include the identification of individual electrical wires in harnesses such as employed in the aerospace industry, identification of wires assembled in electrical panels, identification of wires in the appliance industry, and wire identification in the shipbuilding and electrical construction industries. The sleeves also may be used for the identification of other cylindrical articles, such as pipes, conduits, and rods.

The novel assemblies of tubular sleeve markers described above have numerous advantages that can be important to the manufacturer of the assemblies. Among these are that the use of a single top web or a plurality of top webs of narrower width than the base web facilitates manufacturing operations by reducing the need for complicated die-cutting operations that require precise registration of webs. Also, the described width relationship permits the production of sleeve markers having tabs at each end to enhance opening of a flat sleeve for insertion on a cylindrical object. It should be noted, however, that the sleeve markers disclosed above can be made with a tab at only one end if desired, which also is made possible by using top webs narrower than the base web. Standard die-cutting, perforating, sealing and slitting operations can be employed to produce the assemblies and accurate registration of top webs with a base web can be readily accomplished. Manufacturing techniques for handling webs of flexible materials which are employed to produce the assemblies of this invention are well-known. An assembly of sleeve markers has been provided that readily lends itself to manufacture either as pre-printed assemblies for sale to customers or as unprinted assemblies to which the customer applies selected identifying information.

The assemblies of tubular sleeve markers disclosed above also provide a number of useful advantages to the users of the assembly. The assemblies can be supplied either as flat sheets, rolls or fan-folded, whichever is most suitable for a particular end use. The assemblies can be advanced through various types of programmable typewriters, word processing equipment, line printers associated with computers, hot stamping equipment, etc., so that an end user can apply selected serialized or other suitable identification indicia to the individual sleeve markers of an assembly. This can be accomplished with little or no mechanical modifications to either typewriters, line printers or other types of printing equipment. The assemblies can be made of many types of flexible sheet materials, so that end users can have selected combinations tailored to be appropriate for various types of environments. For example, the sheet materials can be selected to be appropriate for exposure to particular thermal conditions, exposure to specified liquids, or other ambient conditions. Furthermore, an end user is provided with a tubular sleeve marker system that is cost effective inasmuch as the assemblies of this invention can be supplied at a significantly lower cost than some of the other tubular marker systems currently available on the market that are adapted for printing of the identification indicia by the end user.

One of the principal objects of this invention was to develop new constructions for assemblies of tubular sleeve markers that possess the foregoing advantages and another was to devise a sequence of manufacturing steps especially suitable for production of the new assemblies, which objectives have been met by the constructions and techniques described hereinabove.

We claim:

1. An assembly of individual tubular sleeve markers detachably joined together comprising, in combination:

(1) a base web and a top web of flexible sheet material arranged in face-to-face relationship and having longitudinal axes disposed parallel to one another, the top web having first and second longitudinal edges spaced inwardly of first and second longitudinal edges of the base web, and the base web including a first marginal edge portion extending beyond the first longitudinal edge of the top web and a second marginal edge portion extending beyond the second longitudinal edge of the top web;

(2) a plurality of spaced transverse seams joining the base web and the top web together at preselected intervals, the transverse seams being arranged perpendicular to the longitudinal axes of the base and top webs, each adjacent pair of transverse seams defining opposed closed edge portions of an individual tubular sleeve marker;

(3) first separable line means defined in the first marginal edge portion of the base web and second separable line means defined in the second marginal edge portion of the base web, the first and second separable line means each being parallel to the longitudinal axis of the base web, the first separable line means and the first longitudinal edge of the top web defining a first open end of a sleeve marker, and the second separable line means and the second longitudinal edge of the top web defining a second open end of a sleeve marker; and (4) each individual tubular sleeve marker being detachable from the assembly along said transverse seams and said separable line means.

2. An assembly of individual tubular sleeve markers according to claim 1, wherein:

the first separable line means is spaced from the first longitudinal edge of the top web and the second separable line means is spaced from the second longitudinal edge of the top web to define tab portions of the base web which extend beyond the first and second longitudinal edges of the top web at each of the top ends of an individual sleeve marker.

3. An assembly of individual tubular sleeve markers as defined in claim 1, wherein:

a weakened zone is defined across each transverse seam as a thinned-down portion of the base and top webs, and each individual sleeve marker is detachable from the assembly along a weakened zone.

4. An assembly of individual tubular sleeve markers as defined in claim 1, wherein:

a line of weakness extends across each transverse seam, and an individual sleeve marker is manually detachable from the assembly along a line of weakness.

5. An assembly of individual tubular sleeve markers as defined in claim 1, wherein:

each transverse seam comprises an array of spaced seamed areas separated by lands, and a line of weakness extending medially of the seamed areas.

6. An assembly of individual tubular sleeve markers as defined in claim 1, 2, 3, 4 or 5, wherein:

a row of spaced apertures extends across the first and second marginal edge portions of the base web parallel to the longitudinal axis thereof.

7. An assembly of two or more rows of individual tubular sleeve markers detachably joined together comprising, in combination:

(1) a base web having spaced first and second marginal edge portions, and a plurality of top webs having longitudinal axes disposed parallel to a longitudinal axis of the base web, each top web having first and second longitudinal edges, the first marginal edge portion of the base web extending beyond the top web adjacent thereto and the second marginal edge portion of the base web extending beyond the top web adjacent thereto at an opposite edge of the assembly, each adjacent pair of top webs being spaced from one another with an exposed section of base web therebetween;

(2) a plurality of spaced transverse seams joining the base web and the top webs together at preselected intervals, the transverse seams being arranged perpendicular to the longitudinal axes of the base and top webs, each adjacent pair of transverse seams defining opposed closed edge portions of an individual tubular sleeve marker;

(3) first separable line means defined in the first marginal edge portion of the base web, second separable line means defined in the second marginal edge portion of the base web, and third separable line means defined in each exposed section of the base web between adjacent top webs, each individual sleeve marker having a first open end defined by a separable line means and a first longitudinal edge of a top web and a second open end defined by a separable line means and the second longitudinal edge of a top web; and (4) each individual tubular sleeve marker being detachable from the assembly along said transverse seams and adjacent pairs of said separable line means.

8. An assembly of individual tubular sleeve markers according to claim 7, wherein:

the first, second and third separable line means are each spaced from an adjacent longitudinal edge of a top web to define tab portions of the base web which extend beyond the longitudinal edges of a top web at each of the open ends of an individual sleeve marker.

9. An assembly of individual tubular sleeve markers as defined in claim 7, wherein:

a weakened zone is defined across each transverse seam as a thinned-down portion of the base and top webs, and each individual sleeve marker is detachable from the assembly along a weakened zone.

10. An assembly of individual sleeve markers as defined in claim 7, wherein:

a line of weakness extends across each transverse seam, and an individual sleeve marker is manually detachable from the assembly along a line of weakness.

11. An assembly of individual tubular sleeve markers as defined in claim 7, wherein:

each transverse seam comprises an array of spaced seamed areas separated by lands, and a line of weakness extending medially of the seamed areas.

12. An assembly of individual tubular sleeve markers as defined in claim 7, 8, 9, 10 or 11, wherein:

a row of spaced apertures extends across the first and second marginal edge portions of the base web parallel to the longitudinal axis thereof.

* * * * *

UNITED STATES PATENT AND TRADEMARK OFFICE

CERTIFICATE OF CORRECTION

PATENT NO. : 4,361,230

DATED : Nov. 30, 1982

INVENTOR(S) : Downing et al.

It is certified that error appears in the above—identified patent and that said Letters Patent is hereby corrected as shown below:

Col. 11, line 14, "top" should be -- open --.

Signed and Sealed this

*First* Day of *February 1983*

[SEAL]

*Attest:*

GERALD J. MOSSINGHOFF

*Attesting Officer*

*Commissioner of Patents and Trademarks*